US007946874B2

(12) United States Patent
Sakamaki et al.

(10) Patent No.: US 7,946,874 B2
(45) Date of Patent: May 24, 2011

(54) WATERPROOF STRUCTURE HAVING A SEALING MEMBER PRESSED AGAINST AN INNER HOUSING BY AN OUTER HOUSING HAVING THROUGH-HOLES WITH A PROJECTION

(75) Inventors: Kazushige Sakamaki, Tokyo (JP); Ryuichi Komiyama, Tokyo (JP)

(73) Assignee: Tyco Electronics Japan G. K., Kanagawa-Ken (JP)

( * ) Notice: Subject to any disclaimer, the term of this patent is extended or adjusted under 35 U.S.C. 154(b) by 0 days.

(21) Appl. No.: 12/904,764

(22) Filed: Oct. 14, 2010

(65) Prior Publication Data

US 2011/0028036 A1 Feb. 3, 2011

Related U.S. Application Data

(63) Continuation of application No. PCT/JP2009/057213, filed on Apr. 8, 2009.

(30) Foreign Application Priority Data

Apr. 17, 2008 (JP) ..... 2008-107713

(51) Int. Cl.
*H01R 13/52* (2006.01)

(52) U.S. Cl. ..... 439/275

(58) Field of Classification Search ..... 439/275, 439/271, 587, 588, 376, 377, 380
See application file for complete search history.

(56) References Cited

U.S. PATENT DOCUMENTS

| | | | | |
|---|---|---|---|---|
| 5,679,019 | A * | 10/1997 | Sakai et al. | 439/275 |
| 5,820,417 | A * | 10/1998 | Yamada | |
| 6,257,928 | B1 * | 7/2001 | Murakami et al. | 439/587 |
| 6,322,401 | B2 * | 11/2001 | Suzuki | |
| 6,913,486 | B2 * | 7/2005 | Nagayasu et al. | 439/587 |
| 7,114,991 | B2 * | 10/2006 | Shiga et al. | 439/587 |
| 7,285,012 | B2 * | 10/2007 | Wada et al. | 439/587 |
| 7,628,654 | B2 * | 12/2009 | Hori et al. | 439/637 |
| 2005/0245130 | A1 * | 11/2005 | Shiga et al. | 439/587 |
| 2009/0191760 | A1 * | 7/2009 | Hori et al. | 439/629 |

FOREIGN PATENT DOCUMENTS

| | | |
|---|---|---|
| JP | 09-102348 | 4/1997 |
| JP | 11-354197 | * 12/1999 |

(Continued)

OTHER PUBLICATIONS

International Search Report for PCT/JP2009/057213 dated May 19, 2009, 1 page.

*Primary Examiner* — Chandrika Prasad
(74) *Attorney, Agent, or Firm* — Barley Snyder LLC

(57) ABSTRACT

A waterproof structure includes an inner housing, a family sealing member, an outer housing, a projection. The family sealing member is positioned on the inner housing. The outer housing is positioned adjacent to the family sealing member, and presses the family sealing member against the inner housing. A plurality of contact receiving cavities are further provided and positioned in the inner housing, while a plurality of insertion holes are positioned in the family sealing member. Each insertion hole includes a circular cross-section, and corresponding to the plurality of contact receiving cavities respectively. A plurality of through holes are positioned in the outer housing and correspond to the plurality of insertion holes, respectively. Each through hole penetrate though the outer housing in the contact inserting direction, and the projection is provided in each of the plurality of through holes.

19 Claims, 8 Drawing Sheets

FOREIGN PATENT DOCUMENTS

| | | |
|---|---|---|
| JP | 2000-268915 | 9/2000 |
| JP | 2001-244011 | 9/2001 |
| JP | 2001-244018 | 9/2001 |
| JP | 2002-175850 | 6/2002 |
| JP | 2002-184511 | 6/2002 |
| JP | 2006-019076 | 1/2006 |

* cited by examiner

WATERPROOF STRUCTURE HAVING A SEALING MEMBER PRESSED AGAINST AN INNER HOUSING BY AN OUTER HOUSING HAVING THROUGH-HOLES WITH A PROJECTION

CROSS-REFERENCE TO RELATED APPLICATIONS

This application is a continuation of PCT International Application No. PCT/JP2009/057213, filed Apr. 8, 2009, which claims priority under 35 U.S.C. §119 to Japanese Patent Application No. JP 2008-107713, filed Apr. 17, 2008.

FIELD OF THE INVENTION

The invention relates to a waterproof connector and in particular to a waterproof connector having a waterproof structure with a family sealing member.

BACKGROUND

Conventionally, as an example, a connector shown in FIG. 8 has been known as a waterproof connector 101 with a waterproof structure having a family sealing member.

The waterproof connector 101 shown in FIG. 8 is provided with a housing 110 having multiple contact receiving cavities 111, multiple contacts 150 received in the contact receiving cavities 111, respectively, a family sealing member 120, and a family sealing press member 130. The family sealing member 120 fits in a depression portion 112 formed at the rear end (the right end portion in FIG. 8, the proximal side edge portion in the contact inserting direction) of the housing 110, while the family sealing press member 130 attaches to the housing 110 from the rear side of the family sealing member 120 and is positioned at the rear side of the family sealing member 120 (proximal side in the contact inserting direction) for pressing the family sealing member 120 against the housing 110.

Each of the contact receiving cavities 111 of the housing 110 is provided with a housing lance 113 which locks with the contact 150 that has is inserted into the contact receiving cavity 111.

Each contact 150 is formed by stamping and forming a metal plate, and is provided with a shaped receptacle portion 151 for receiving a mating contact (not shown); and an electric wire connection portion 152 for connecting an electric wire W. The horizontal cross-sectional shape of the receptacle portion 151 is larger than that of the electric wire W.

Additionally, the family sealing member 120 is a plate-shaped member made of rubber. The family sealing member 120 is provided with multiple insertion openings 121 each having a circular cross-sectional shape, in the embodiment shown, and penetrating through in the contact inserting direction to correspond to the contact receiving cavity 111 in the housing 110. Each insertion opening 121 is provided with a sealing circular rib 122 in close contact with the outer circumferential surface of the electric wire W connected to the electric wire connection portion 152 of the contact 150 so as to provide a waterproof function.

Furthermore, the family sealing press member 130 is provided with multiple through holes 131 each having a square cross-sectional shape in the embodiment shown and penetrating through in the contact inserting direction to correspond to the insertion opening 121 of the family sealing member 120. The horizontal cross-sectional area of each through hole 131 is larger than that of each insertion opening 121.

Specifically, in receiving each contact 150 in each contact receiving cavity 111, each contact 150 is inserted, with the receptacle portion 151 of each contact 150 set as a forehead, into a rear side of the family sealing press member 130 (proximal side in the contact inserting direction), the through hole 131, and the insertion opening 121 of the family sealing member 120. Then, each contact 150 is inserted into each contact receiving cavity 111 and each housing lance 113 locks the receptacle portion 151 of each contact 150, so each contact 150 is locked by the housing 110. The family sealing member 120, used as a waterproof function, and the family sealing press member 130, used for pressing the family sealing member 120 against the housing 110, constitute a waterproof structure 140.

In this situation, in inserting each contact 150 into each insertion opening 121 of the family sealing member 120, the end edge portion or the corner portion in the receptacle portion 151 of each contact 150 makes contact with the family sealing member 120, which may result in damage to the family sealing member 120, in some cases (i.e. the sealing circular rib 122 of the family sealing member 120). For this reason, an end edge portion or the corner portion in the receptacle portion 151 of each contact 150 is rounded to avoid any damage to the family sealing member 120.

As another example, a connector shown in FIG. 9 has been known as a waterproof connector 201 for regulating the insertion operation at an abnormal position of the contact, although it is not for avoiding any damage on the family sealing member directly. The waterproof connector 201 shown in FIG. 9 is provided with a housing 210 with multiple contact receiving cavities 211, and multiple contacts 220 received in the contact receiving cavities 211 of the housing 210, respectively.

Each contact 220 includes a shaped receptacle portion 221 for receiving the mating contact (not shown) and an electric wire connection portion, not shown. Specifically, in the embodiment shown, chamfered portions 226 and 227 that recede to the inner side from the up-and-down and left-and-right outer surfaces of the receptacle portion 221 are arranged at two corner positions out of four corner portions included in the receptacle portion 221, which has a substantially rectangular cross-section. This makes the shapes of opposing two pairs of corner portions 223 and 225, and corner portions 224 and 222 different from each other, and also makes the shapes of adjacent corner portions 222 and 223, and corner portions 224 and 225, in a circumferential direction, different from each other.

The contact receiving cavity 211 of the housing 210 has oblique sides 212 and 213 corresponding to the chamfered portions 226 and 227, respectively, when the receptacle portion 221 of the contact 220 is inserted thereinto at a normal position.

If the receptacle portion 221 of the contact 220 is inserted into the contact receiving cavity 211 at an abnormal position (at the position of 90 degrees rotation), the corner portions 222 and 225 that are not provided with the chamfered portions 226 and 227, respectively, interfere with the oblique sides 212 and 213 to regulate the insertion of the contact 220.

Since the chamfered portions 226 and 227 that are the measure for regulating the insertion of the contact 220 recede to the inner side from the up-and-down and left-and-right outer surfaces of the receptacle portion 221, the inner wall of the insertion hole is not damaged when the contact 220 is inserted into the insertion hole of the family sealing member (not shown).

It should be noted that, however, waterproof connectors such as the waterproof connector 101 shown in FIG. 8 and the waterproof connector 201 shown in FIG. 9 are generally used in the automobile industry, and there is a general need for downsizing the waterproof connector in recent years. Such a need for downsizing the waterproof connector also concerns the downsizing of the contacts, as well. However, the sizes of the electric wires to be connected to the contacts remain unchanged, although the contacts need to be downsized. Specifically, the diameter of the electric wire to be connected to the contact has a certain range (an example range is ϕ about 1.7 mm to ϕ about 2.4 mm), and the portion having the largest diameter in the outer shape of the contact (receptacle portion) has to be made smaller than the largest size of the diameter of the electric wire.

In the waterproof connector 101 shown in FIG. 8, if the largest diameter in the outer shape of the contact 150 of the receptacle portion 151 has to be made smaller than the largest size of the diameter of the electric wire W without changing the diameter size of the electric wire W, the outer shape of the receptacle portion 151 is smaller in the insertion of each contact 150 into each insertion opening 121 of the family sealing member 120. Therefore, if the receptacle portion 151 is inserted into the insertion opening 121 in a straight manner, the end edge portion or the corner portion in the receptacle portion 151 will not contact the family sealing member 120 at a large angle and will not damage the family sealing member 120.

However, since the diameter size of the electric wire W remains unchanged, there is a limitation of making smaller the diameter in the horizontal cross-section of the through hole 131 in the family sealing press member 130 arranged at the contact insertion side (rear side) of the family sealing member 120 in order to allow the insertion of the electric wire W having the largest size. Besides, in the insertion of each contact 150 into each insertion opening 121 in the family sealing member 120, the receptacle portion 151 is obliquely inserted into the through hole 131, in some cases. In such cases, the receptacle portion 151 is obliquely inserted into the insertion opening 121 of the family sealing member 120, the end edge portion or the corner portion in the receptacle portion 151 contacts the family sealing member 120 at a large angle, and the family sealing member 120 may become damaged in some cases.

Meanwhile, when the largest diameter in the outer shape of the receptacle portion 151 in the contact 150 is made smaller than the largest diameter size of the electric wire W, it is difficult to round the end edge portion or the corner portion of the receptacle portion 151. Therefore, if the receptacle portion 151 in the contact 150 is obliquely inserted into the through hole 131, damage given to the family sealing member 120 cannot be avoided.

Also, in the case of the waterproof connector 201 shown in FIG. 9, since there is a slight gap between the contact receiving cavity 211 and the receptacle portion 221 of the contact 220, if the largest diameter in the outer shape of the receptacle portion 221 of the contact 220 is made smaller than the largest diameter size of the electric wire, the electric wire will not enter the contact receiving cavity 211, in some cases.

SUMMARY

Accordingly, the invention has been made in view of the above circumstances, and it is an object of the invention, among others, to provide a waterproof structure capable of preventing any damage to a family sealing member, even if a contact is inserted obliquely into a through hole of a family sealing press member arranged at the near side of the family sealing member in a contact inserting direction, and a waterproof connector having the waterproof structure.

The waterproof structure, according to the invention, includes an inner housing, a family sealing member, an outer housing, a projection. The family sealing member is positioned on a near side of the inner housing in a contact inserting direction. The outer housing is positioned on the near side of the family sealing member in the contact inserting direction, and presses the family sealing member against the inner housing. A plurality of contact receiving cavities are further provided and positioned in the inner housing, while a plurality of insertion holes are positioned in the family sealing member. Each insertion hole includes a circular cross-section, and are positioned corresponding to the plurality of contact receiving cavities respectively. A plurality of through holes are positioned in the outer housing and correspond to the plurality of insertion holes, respectively. Each through hole penetrate though the outer housing in the contact inserting direction, and the projection is provided in each of the plurality of through holes.

BRIEF DESCRIPTION OF THE DRAWINGS

The invention is described in more detail in the following with reference to the embodiments shown in the drawings. Similar or corresponding details in the Figures are provided with the same reference numerals. The invention will be described in detail with reference to the following figures of which.

DETAILED DESCRIPTION OF THE EMBODIMENT(S)

Embodiments of the invention will be described with reference to the drawings.

Figure 1:
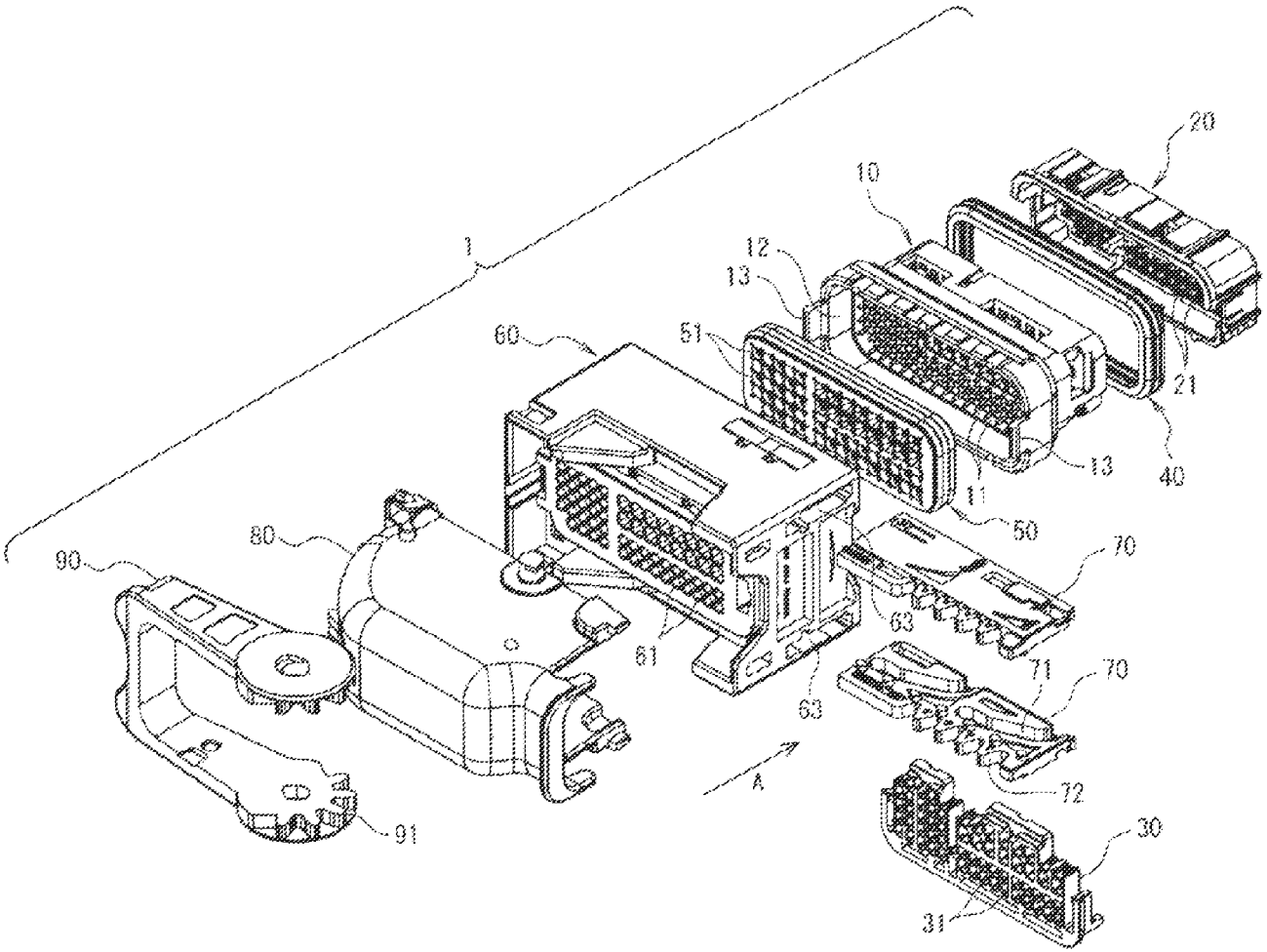
FIG. 1 is an exploded perspective view of a waterproof connector having a waterproof structure according to the invention.

A waterproof connector 1 shown in FIG. 1 is a lever-type connector that employs a lever mechanism, and is provided with an inner housing 10 for receiving multiple contacts 2 (see FIG. 5A to FIG. 5C), a front cover 20, a retainer 30, a sealing member 40, a family sealing member 50, an outer housing 60, a pair of sliders 70, a wire cover 80, and a lever 90.

Figure 5A:
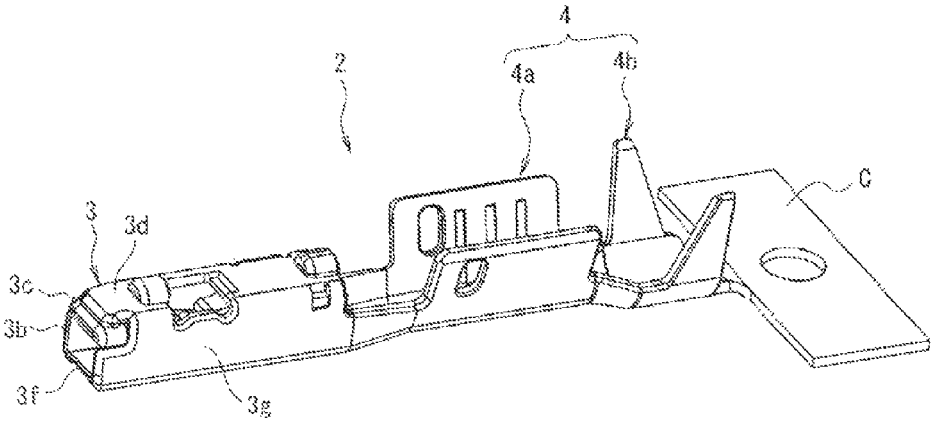
FIG. 5A is a perspective view of a contact according to the invention.
Figure 5B:
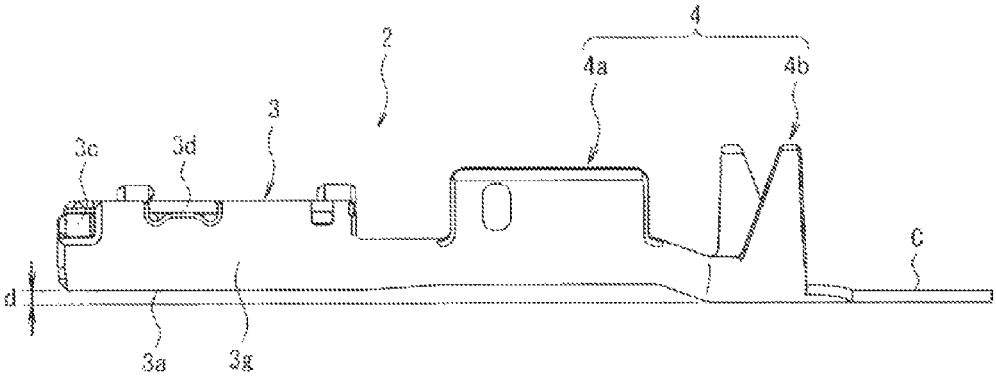
FIG. 5B is a side view of the contact of FIG. 5A.
Figure 5C:
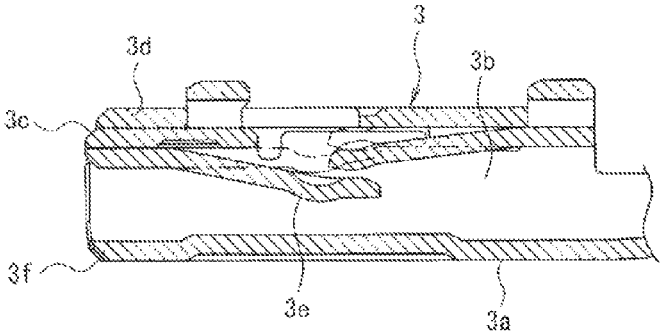
FIG. 5C is a cross-sectional view of a receptacle portion of the contact according to the invention.

Firstly, each contact 2 includes a shaped receptacle portion 3 and an electric wire connection portion 4, as shown in FIG. 5A to FIG. 5C, and is formed by stamping and forming a metal plate. The receptacle portion 3 includes a base plate portion 3*a*, a pair of side walls 3*b* and 3*g*, a lower plate portion 3*c*, and an upper plate portion 3*d*. The base plate portion 3*a* extends in the front-rear direction (left-right direction of FIG. 5B) of the receptacle portion 3, while the pair of side walls 3*b* and 3*g* rise from both side edges of the base plate portion 3*a*. The lower plate portion 3*c* extends from the side wall 3*b* to the side wall 3*g* (from one of the side walls to the other of the side walls), and the upper plate portion 3*d* extends from the side wall 3*g* to the side wall 3*b* (from the other of the side walls to one of the side walls) and arranged on the lower plate portion 3*c*.

A male mating contact, not illustrated, is inserted into the receptacle portion 3. An elastic contact piece 3*e* in an elastic contact with the mating contact extends from the lower plate portion 3*c*. The electric wire connection portion 4 includes a wire barrel 4*a* for press bonding the core wire of the electric wire, not illustrated, and an insulation barrel 4*b* for press bonding the coated portion of the electric wire. Immediately after each contact 2 is stamped from the metal plate and then formed, the rear end portion of the insulation barrel 4*b* is connected to a carrier C as shown in FIG. 5A and FIG. 5B, whereas a front portion 3*f* of the base plate portion 3*a* in the receptacle portion 3 is connected to a carrier, not illustrated. Then, each contact 2 is disconnected from the carrier at the time of being inserted into the inner housing 10.

In this situation, the diameter size of the electric wire to be connected to the contact 2 has a certain range (an example range is ϕ about 1.7 mm to ϕ about 2.4 mm). The largest diameter in the outer shape of the receptacle portion 3 in the contact 2 is smaller than the largest size of the diameter of the electric wire (an example is ϕ about 2.4 mm).

Next, as shown in FIG. 1, the inner housing 10 has a front and rear side and is configured to extend in the widthwise direction, in the vertical direction, and in the front-rear direction. The inner housing 10 is formed by molding an insulating resin. The inner housing 10 is provided with multiple contact receiving cavities 11 that penetrate through in the front-rear direction. Into each contact receiving cavity 11, the contact 2 is inserted in an insertion direction (in the direction of arrow A in FIG. 1, which is directed the front-side of the inner housing 10) with the receptacle portion 3 set at the forefront. Then, each contact 2 is temporarily locked by a housing lance, not illustrated. Also, the rear side of the inner housing 10 is provided with a family sealing member receiving space 12 for receiving the family sealing member 50. Both ends in the widthwise direction of the inner housing 10 have a pair of latch arms 13 for latching the outer housing 60 with the inner housing 10.

In addition, the front cover 20 is attached at the front side of the inner housing 10. The front cover 20, as shown in FIG. 1, extends in the widthwise direction to cover the front surface of the inner housing 10, and has multiple mating contact insertion openings 21 into which the mating contacts are inserted.

The retainer 30 is attached into a retainer receiving depression portion (not illustrated) arranged at the inner housing 10 from the lower side of the inner housing 10, and is formed to have a substantially plate shape in the embodiment shown, and extends in the widthwise direction, as shown in FIG. 1. The retainer 30 has multiple contact insertion openings 31 to correspond to the multiple contact receiving cavities 11 arranged in the inner housing 10, respectively. Then, the retainer 30 is temporarily retained by the inner housing 10 at a temporal locking position where the contact 2 can be inserted into the contact receiving cavity 11 through the contact insertion opening 31, and is further pushed to secure on the inner housing 10 at a proper locking position. When the retainer 30 is secured on the inner housing 10 at the proper locking position, the contact 2 is secondarily locked by the retainer 30.

The sealing member 40, shown in FIG. 1, is formed to have a ring shape and brought into close contact with the outside of the inner housing 10. The sealing member 40 seals between the mating connector and the inner housing 10, when the mating connector is fit into the waterproof connector 1. The sealing member 40 has a function of preventing water from entering into the inner housing 10 from the fitting portion.

Figure 2A:
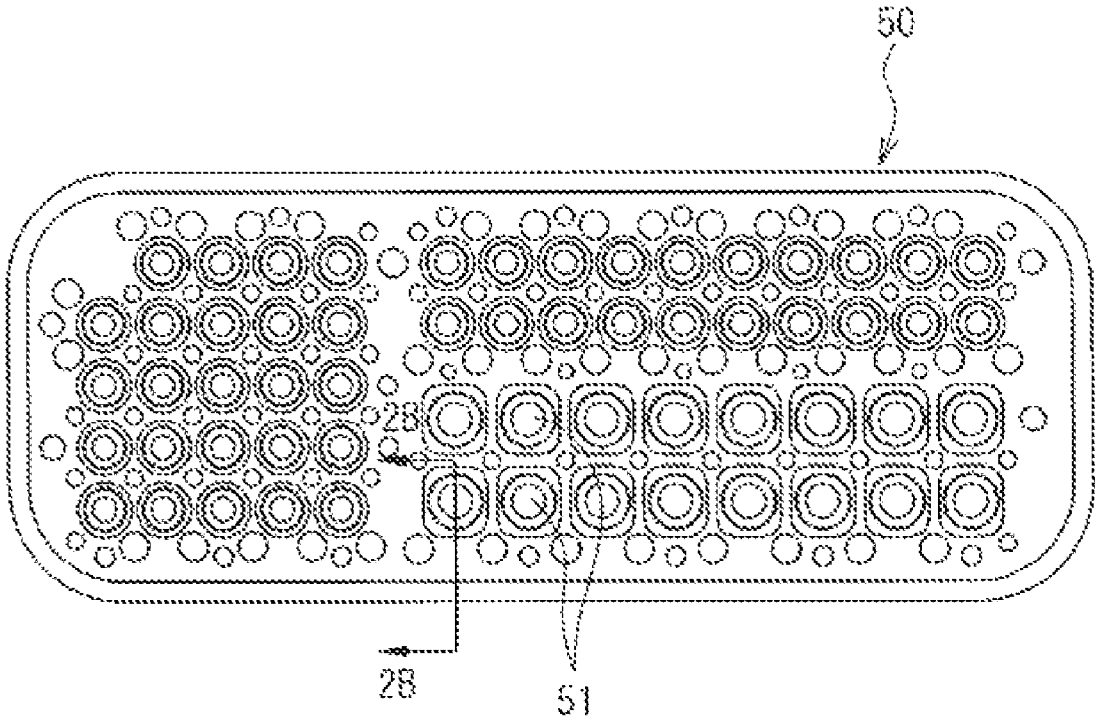
FIG. 2A is a front view of a family sealing member according to the invention.
Figure 2B:
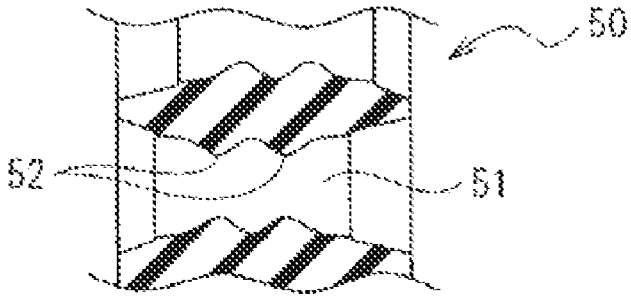
FIG. 2B is a cross-sectional view of the family sealing member of FIG. 2A taken along a line 2B-2B in FIG. 2A.

The family sealing member 50 is made of rubber and has a substantially plate shape, as shown in FIG. 1 and FIG. 2, and is received in the family sealing member receiving space 12 arranged in the proximal side, in the contact inserting direction, of the inner housing 10. Thus, the family sealing member 50 is arranged at the proximal side of the contact inserting direction of the inner housing 10. Then, the family sealing member 50 is brought into close contact with the inner circumferential surface of the outer wall portion in the family sealing member receiving space 12. The family sealing member 50 includes multiple insertion holes 51, each having a circular cross-section, arranged at positions corresponding to the contact receiving cavities 11 arranged in the inner housing 10, respectively. Each of the insertion holes 51 penetrates through in the contact inserting direction, as shown in FIG. 1, FIG. 2A and FIG. 2B. The electric wire (not illustrated) connected to the contact 2 received in the contact receiving cavity 11 is extended through the insertion hole 51 to the rear side. The inner circumferential surface of each insertion hole 51 is provided with multiple sealing portions 52, as shown in FIG. 2B. The circular sealing portion 52 is brought into close contact with the outer surface of the electric wire to prevent water from entering into the inside of the inner housing 10 from the insertion hole 51.

Figure 3A:
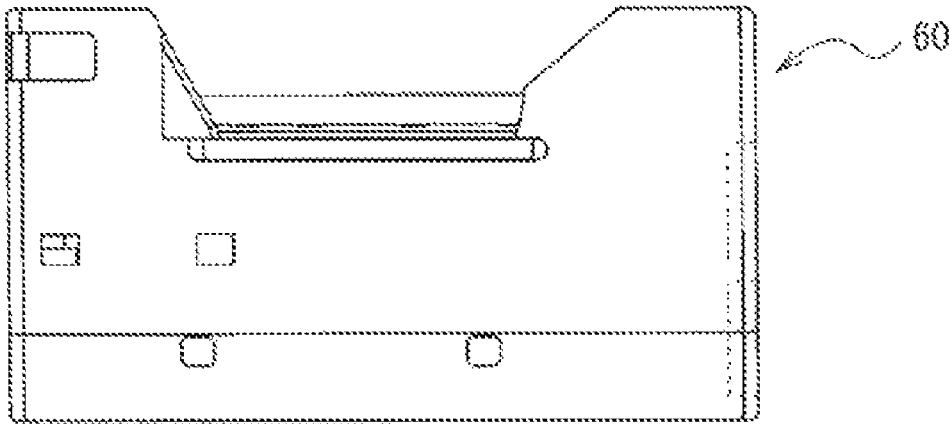
FIG. 3A is a plan view of an outer housing according to the invention.
Figure 3B:
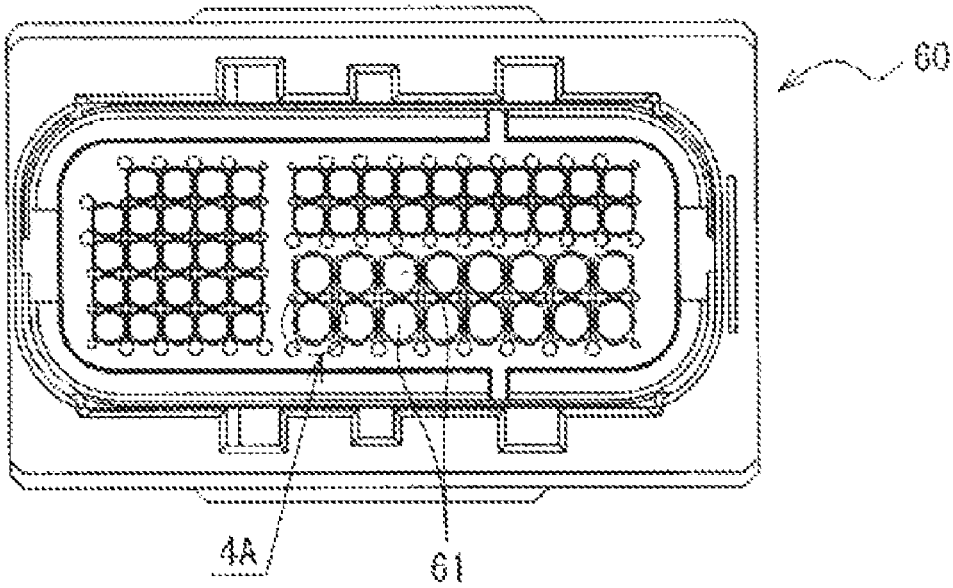
FIG. 3B is a front view of the outer housing of FIG. 3B.

Moreover, the outer housing 60 is arranged at the near side (rear side) in the contact inserting direction of the family sealing member 50, and is latched to the inner housing 10 by the latch arm 13 of the inner housing 10. Thus, the family sealing member 50 is pressed against the inner housing 10. The outer housing 60 is formed to have a shape of substantially cuboid extending in the widthwise, front-rear, and up-down directions, as shown in FIG. 1, FIG. 3A, and FIG. 3B. The outer housing 60 includes multiple through holes 61, each having a square cross-section, arranged at positions corresponding to the insertion holes 51 included in the family sealing member 50, as shown in FIG. 1, FIG. 3A, FIG. 3B, and FIG. 4A to FIG. 4C. Each of the through holes 61 penetrates through in the contact inserting direction. The electric wire connected to each contact 2 is extended through each insertion hole 51 in the family sealing member 50 and the through hole 61 in the outer housing 60 to the rear side. The family sealing member 50 and the outer housing 60 constitute a waterproof structure.

Figure 4A:
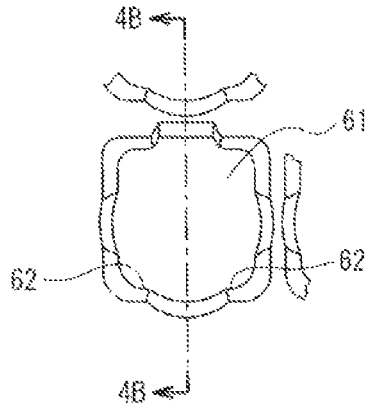
FIG. 4A is an enlarged view of a through hole arranged at the outer housing according to the invention indicated by an arrow 4A in FIG. 3B.
Figure 4B:
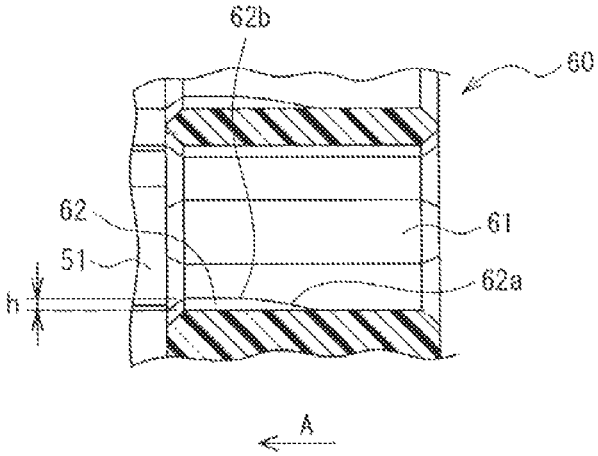
FIG. 4B is a cross-sectional view of the through hole of FIG. 4A taken along a line 4B-4B in FIG. 4A.
Figure 4C:
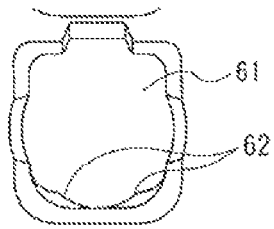
FIG. 4C is an enlarged view of the through hole when the through hole is viewed from the rear surface side.

Each through hole 61 has projections 62 each giving a rotational moment in the direction of cancelling the oblique insertion of the contact 2, when the receptacle portion 3 of the contact 2 is inserted into the through hole 61 obliquely. The projection 62 is arranged at a portion of a circumferential wall surface (the lower wall surface in the present embodiment) in the through hole 61 as shown in FIG. 4A to FIG. 4C such that the projection 62 into contact with a part, getting into contact with the family sealing member 50 and giving damage to the family sealing member 50, in the receptacle portion 3 arranged in the contact 2 (the front portion 3*f* of the base plate portion 3*a* in the receptacle portion 3, where the carrier is disconnected, in the present embodiment) so as to give a rotational moment to the contact 2. Incidentally, since the front portion 3*f* of the base plate portion 3*a* in the receptacle portion 3 is a part where the carrier is disconnected, the cut surface is sharp. Once the front portion 3*f* is brought into contact with the family sealing member 50 made of rubber, the family sealing member 50 is easily damaged.

Furthermore, the projection 62 is arranged on the far side from the middle of the through hole 61, in the contact inserting direction (in the direction of arrow A in FIG. 4B). Also, the projections 62 are arranged in a bilaterally symmetric manner as shown in FIG. 4A and FIG. 4C. Each projection 62 rises at an inclined surface 62*a* with respect to the contact inserting direction as shown in FIG. 4B, whereas a top surface 62*b* is substantially parallel to the contact inserting direction. The height "h" of each projection 62 is substantially equal to a gap "d" (see FIG. 5B) between the lower surface of the insulation barrel 4*b* in each contact 2 and the lower surface of the base plate portion 3*a* included in the receptacle portion 3.

Also, a pair of slider receiving grooves 63 extending in the widthwise direction are arranged at both upper and lower end portions of the outer housing 60 (see FIG. 1).

Each slider 70 shown in FIG. 1 is formed to have a substantially plate shape, and is slidably received in a slider receiving groove 63 of the outer housing 60. The inner surface of each slider 70 has a cam groove 71 into which a cam pin (not illustrated) arranged at the mating connector enters. A rack portion 72 is arranged at the rear end edge of each slider 70.

In addition, the wire cover 80 is attached to the rear side of the outer housing 60, and protects the bundle of electric wires extended to the rear side from each through hole 61 of the outer housing 60.

Furthermore, the lever 90 is rotatably supported with respect to the wire cover 80, and has a pinion portion 91, at an end, for engaging the rack portion 72 arranged at the slider 70. The lever 90 and the slider 70 serve as a lever mechanism. When the lever 90 rotates, the slider 70 moves in the widthwise direction. Thus, the mating connector is pulled toward or separated from the waterproof connector 1.

The operation of the projection 62 will be described in detail. The projection 62 arranged at the through hole 61 of the outer housing 60 will be described together with the method of receiving the contact 2 into the inner housing 10, as well.

Prior to each contact 2 being received in the inner housing 10, the front cover 20 and the sealing member 40 are attached to the inner housing 10, and the family sealing member 50 is received in the family sealing member receiving space 12. Then, after the outer housing 60 is attached to the inner housing 10, the slider 70 is attached to the outer housing 60. Also, the retainer 30 is temporarily retained at a temporal locking position by the inner housing 10.

Subsequently, each contact 2 to which an electric wire is connected is made to penetrate from the rear side of the outer housing 60 by the receptacle portion 3, through the through hole 61 and the insertion hole 51 of the family sealing member 50, and is then inserted into the contact receiving cavity 11 of the inner housing 10. After that, the housing lance locks the contact 2.

Then, when the retainer 30 is made to move to the proper locking position to be secured onto the inner housing 10, the contact 2 is secondarily locked by the retainer 30. Thus, each contact 2 is received into the inner housing 10, and completed.

Figure 6A:
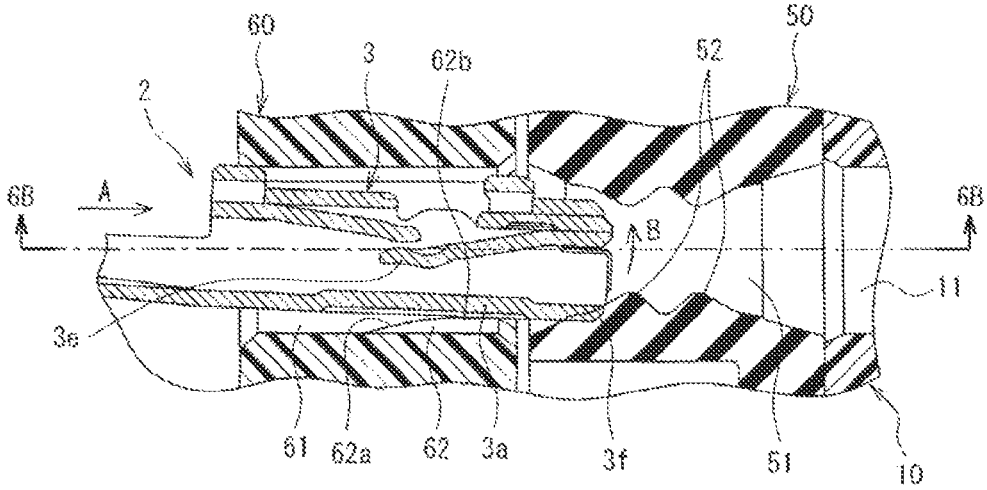
FIG. 6A is a longitudinal sectional view illustrating a projection of an outer housing according to the invention receiving the contact.
Figure 6B:
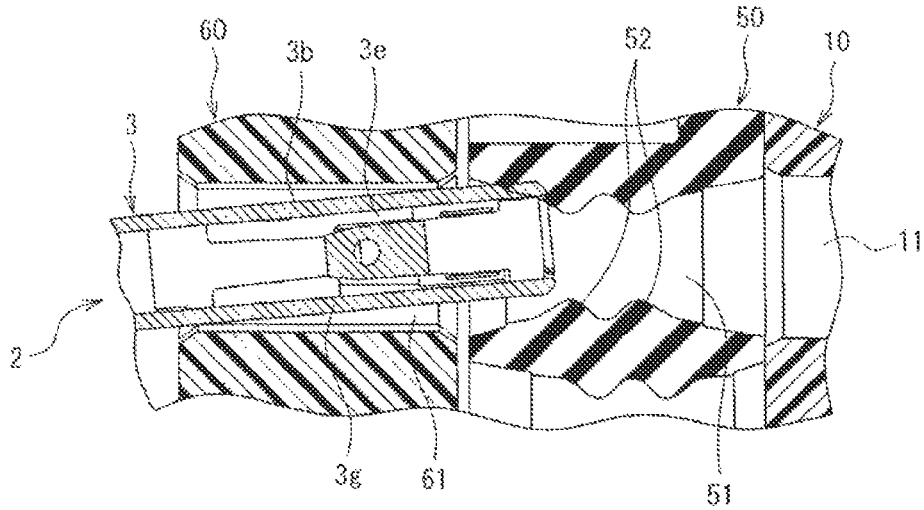
FIG. 6B is a cross-sectional view of the outer housing of 6A taken along a line 6B-6B in FIG. 6A.

The size of the horizontal cross-section of the through hole 61 arranged in the outer housing 60 allows the electric wire having the largest diameter size (an example is ϕ about 2.4 mm) to be inserted into the through hole 61. In addition, the largest diameter in the outer shape of the receptacle portion 3 in the contact 2 is smaller than the largest diameter size of the electric wire. For this reason, when each contact 2 is made to penetrate through the through hole 61 and the insertion hole 51 of the family sealing member 50, the receptacle portion 3 is obliquely inserted into the through hole 61 through in some cases, as shown in FIG. 6A and FIG. 6B. In FIG. 6A and FIG. 6B, the portion in the receptacle portion 3 that comes into contact with the family sealing member 50 and provides damage thereto (the front portion 3*f* of the base plate portion 3*a* in the receptacle portion 3) is obliquely inserted into the through hole 61 in the direction of such that it comes into contact with the family sealing member 50. In such a case, the portion coming into contact with the family sealing member 50 and providing damage is brought into contact with the projection 62, which is arranged at a part of the circumferential wall surface of the through hole 61 (that is the lower wall surface in the present embodiment). This allows the contact 2 to the rotational move in the direction of cancelling the oblique insertion of the contact 2 (in the direction of arrow B in FIG. 6A). Thus, the contact 2 is inserted into the insertion hole 51 of the family sealing member 50 in a substantially straight manner. This prevents the portion in the contact 2 from coming into contact with the family sealing member 50 and causing damage thereto from contacting the family sealing member 50 at a sharp angle (that is an angle in the contact inserting direction). It is therefore possible to avoid any damage given to the family sealing member 50.

In addition, the projection 62 is arranged on the far side from the middle in the contact inserting direction in the through hole 61. Therefore, even if the contact 2 is inserted into the through hole 61 of the outer housing 60 at a dull slant, the projection 62 will be capable of getting into contact with the receptacle portion 3 in the contact 2 with certainty to give the contact 2 a rotational moment in the direction of cancelling the oblique insertion of the contact 2.

Furthermore, the projection 62 rises by the inclined surface 62*a* with respect to the contact inserting direction and the top surface 62*b* is substantially parallel to the contact inserting direction. Therefore, when the receptacle portion 3 is obliquely inserted into the through hole 61, the receptacle portion 3 will not be caught or jammed at the inclined surface 62*a*.

Figure 7A:
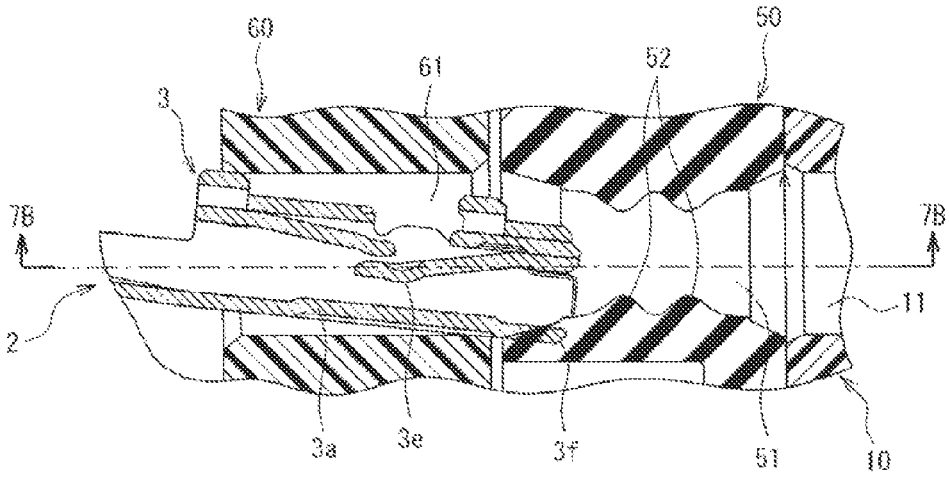
FIG. 7A is a longitudinal sectional view of an outer housing without a projection according to the invention.
Figure 7B:
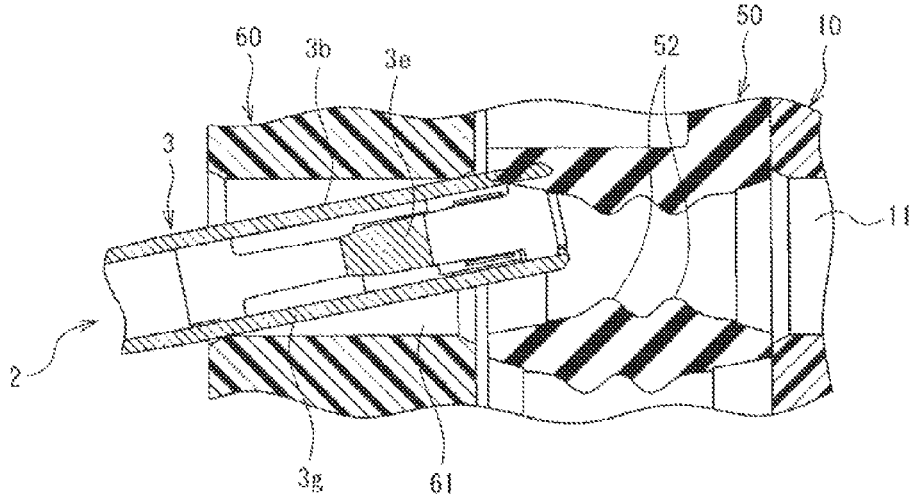
FIG. 7B is a cross-sectional view of the outer housing of FIG. 7A taken along a line 7B-7B in FIG. 7A.
Figure 8:
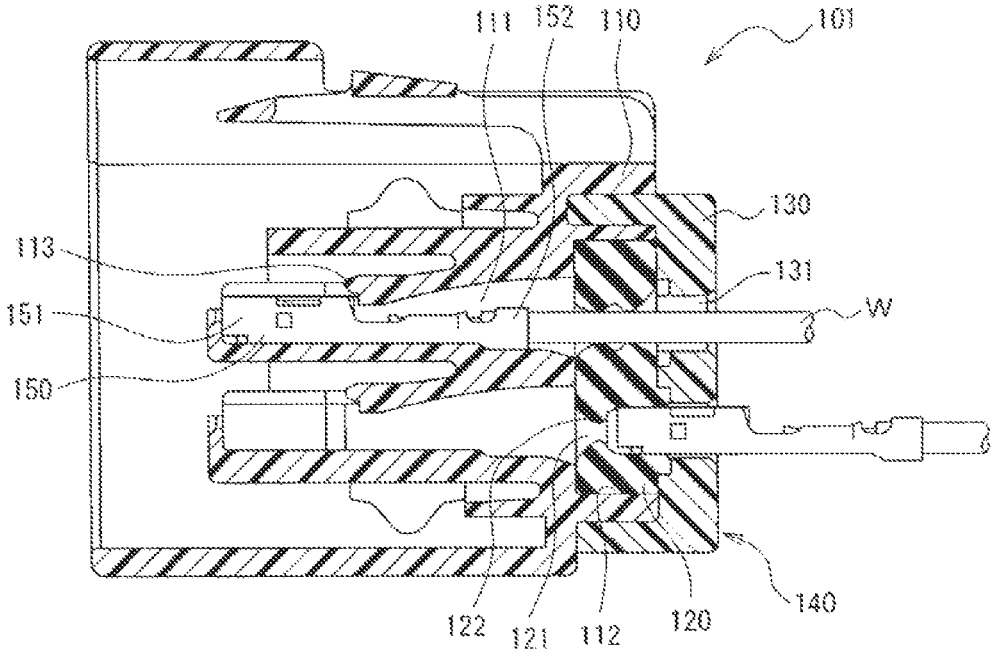
FIG. 8 is a cross-sectional view of a known waterproof connector.
Figure 9:
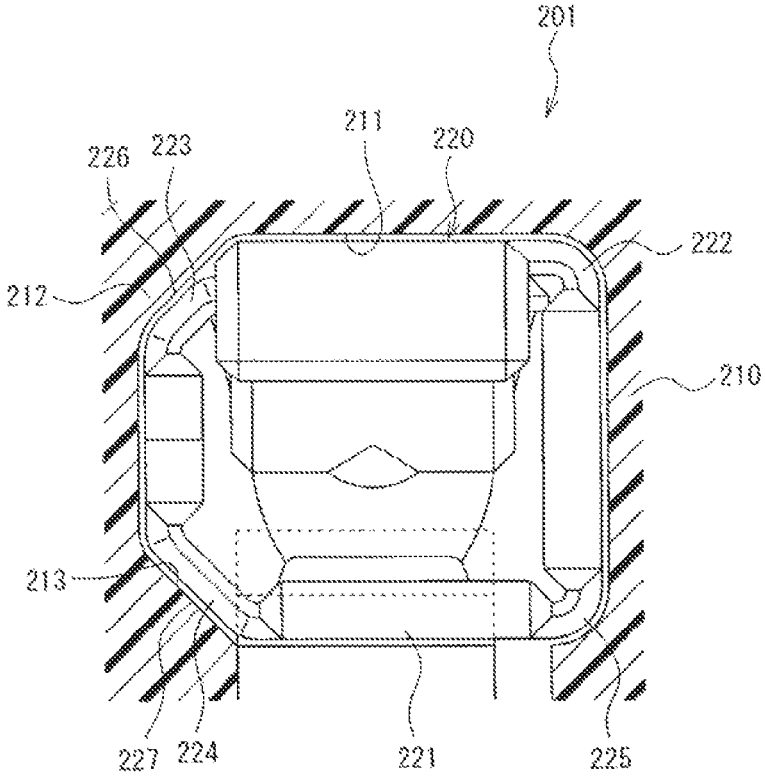
FIG. 9 is a cross-sectional view of substantial parts of another known waterproof connector.

In contrast thereto, when the projection 62 is not provided at the through hole 61, as shown in FIG. 7A and FIG. 7B, and the receptacle portion 3 is inserted into the through hole 61 obliquely, the portion in the receptacle portion 3 makes contact with the family sealing member 50, causing damage thereto (the front portion 3*f* of the base plate portion 3*a* in the receptacle portion 3) since there is no projection 62 provided at the through hole 61. For this reason, it is difficult to avoid damage to the family sealing member 50 if no projection 62 provided at the through hole 61.

After each contact 2 is received in the inner housing 10, the lever 90 is attached to the wire cover 80 and further the wire cover 80 is attached to the outer housing 60, so the waterproof connector 1 is completed.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

For example, in the provision of the projection 62 in the through hole 61, as long as the projection 62 is arranged at a position providing rotational moment to the contact 2 in the direction of cancelling the oblique insertion of the contact 2, the contact 2 avoids contact with the family sealing member 50 and thus damage thereto is avoided since the projection 62 comes into contact with the contact and not the family sealing member 50 at a sharp angle. Additionally, the projection 62 may not necessarily be arranged on the far side from the middle in the contact inserting direction of the through hole 61.

Furthermore, regarding the shape of the projection 62, as long as the projection 62 has a shape that provides rotational moment to the contact 2 such that projection cancels the oblique insertion of the contact 2, the invention is not limited to the illustrated shape.

Moreover, as long as the waterproof connector 1 has a waterproof structure including a family sealing member 50 arranged at the near side in the contact inserting direction in the housing and an outer housing 60 arranged at the near side in the contact inserting direction of the family sealing member 50 for pressing the family sealing member 50 against the inner housing 10, the invention is not limited to the lever-type connector that employs a lever mechanism.

What is claimed is:

1. A waterproof structure comprising:

an inner housing;

a family sealing member positioned on the inner housing; and an outer housing positioned adjacent the family sealing member and pressing the family sealing member against the inner housing;

a plurality of contact receiving cavities positioned in the inner housing;

a plurality of insertion holes positioned in the family sealing member, each having a circular cross-section, and corresponding to the plurality of contact receiving cavities respectively;

a plurality of through holes in the outer housing and corresponding to the plurality of insertion holes, respectively; and a projection in each of the plurality of through holes.

2. The waterproof structure according to claim 1, wherein the projection is positioned along a part of a circumferential wall surface of each through hole.

3. The waterproof structure according to claim 2, wherein the projection extends from an off center location of a lower wall of each through hole.

4. The waterproof structure according to claim 1, wherein an inner circumferential surface of each insertion hole has multiple sealing portions.

5. The waterproof structure according to claim 1, wherein the projection extends from an off center location of a lower wall of each through hole.

6. The waterproof structure according to claim 1, further comprising a plurality of projections extend from off center locations of a lower wall of each through hole.

7. The waterproof structure according to claim 6, wherein each projection is positioned in a bilaterally symmetric manner.

8. The waterproof structure according to claim 1, wherein the projection includes an inclined surface and a top surface arranged along a contact inserting direction.

9. The waterproof structure according to claim 1, wherein the projection has a height that is substantially equal to a gap between a lower surface of an insulation barrel and a lower surface of a base plate portion of a mating contact.

10. A lever-type connector, comprising:

an inner housing for receiving multiple contacts;

a family sealing member positioned on the inner housing; and an outer housing positioned on the family sealing member and pressing the family sealing member against the inner housing;

a plurality of through holes positioned in the outer housing; and a projection in each of the plurality of through holes.

11. A lever-type connector according to claim 10, wherein each contact includes a shaped receptacle portion and an electric wire connection portion having an insulation barrel.

12. A lever-type connector according to claim 11, wherein each receptacle portion includes a base plate portion and a pair of side walls extending from side edges of the base plate portion.

13. The waterproof structure according to claim 12, wherein the projection has a height that is substantially equal to a gap between a lower surface of an insulation barrel and a lower surface of the base plate portion.

14. The waterproof structure according to claim 11, wherein the projection is positioned along a part of a circumferential wall surface of the through hole.

15. The waterproof structure according to claim 14, wherein the projection extends from an off center location of a lower wall of each through hole.

16. The waterproof structure according to claim 11, wherein the projection is positioned toward the family sealing member.

17. The waterproof structure according to claim 11, further comprising a plurality of projections provided in each of the plurality of through holes.

18. The waterproof structure according to claim 17, wherein each projection is positioned in a bilaterally symmetric manner within each of the plurality of through holes.

19. The waterproof structure according to claim 11, wherein the projection includes an inclined surface and a top surface arranged along a contact inserting direction.

* * * * *